United States Patent [19]

Matsuda et al.

[11] Patent Number: 5,064,305

[45] Date of Patent: Nov. 12, 1991

[54] PIN PLATEN MECHANISM

[75] Inventors: Kiyoshi Matsuda; Minoru Mizutani, both of Tokyo, Japan

[73] Assignee: Oki Electric Industry Co., Ltd., Tokyo, Japan

[21] Appl. No.: 29,222

[22] Filed: Mar. 23, 1987

[30] Foreign Application Priority Data

Mar. 28, 1986 [JP] Japan ..... 61-44708[U]

[51] Int. Cl.[5] ..... B41J 11/28

[52] U.S. Cl. ..... 400/616.3; 400/616

[58] Field of Search ..... 400/616, 616.1, 616.2, 400/616.3; 226/81

[56] References Cited

U.S. PATENT DOCUMENTS 1,431,266 10/1922 Shreman ..... 400/616.3 X
3,410,469 11/1968 Deeg ..... 226/81
4,033,493 7/1977 Levinson ..... 226/81
4,133,613 1/1979 Webster ..... 400/616.3
4,571,104 2/1986 Jung et al. ..... 400/616.3

FOREIGN PATENT DOCUMENTS 36-22836 11/1961 Japan .

*Primary Examiner*—Edgar S. Burr
*Assistant Examiner*—Joseph R. Keating
*Attorney, Agent, or Firm*—Wenderoth, Lind & Ponack

[57] ABSTRACT

A pin platen mechanism includes coiled springs mounted in respective retaining holes formed in a sprocket wheel for biasing respective sprocket pins to the outside at all times. A cam groove in a cam member has freely fitted therein projections of the sprocket pins. A wider part of the cam groove enables the pins to be withdrawn inwardly only when necessary.

4 Claims, 6 Drawing Sheets

PIN PLATEN MECHANISM

BACKGROUND OF THE INVENTION

1. Field of the Invention

The present invention relates to a pin platen mechanism for supporting and feeding a medium such as a continuous sheet, a continuous tablet or the like having sprocket holes therethrough.

2. Description of the Prior Art

A pin platen mechanism of this type, which is to be assembled into a printer or the like, includes sprocket wheels each having sprocket pins fitted in the medium sprocket holes, the sprocket wheels being respectively mounted on both ends of a platen serving to support the medium having the sprocket holes therethrough on the side of a printing surface, which sprocket wheels are then rotated integrally with the platen for thereby feeding the medium. If such sprocket pins are fixedly mounted on the sprocket wheels to project from the sprocket wheels at all times, the movement of a ribbon protector mounted on a carriage together with a print head will be disturbed. This limits the movement of the carriage.

To solve this difficulty of limiting the extent of movement of the carriage, a known mechanism, such as disclosed for example in the Japanese Patent Publication No. 36-22836, enables the sprocket pins to move into and out of the sprocket wheel by use of a cam member having a cam groove formed therein and combined with the sprocket wheel. The sprocket pin is withdrawn into the sprocket wheel by the cam groove when the sprocket pin is located on the side of the printing surface.

FIG. 4 is a side cross sectional view illustrating such a known pin platen mechanism which permits a sprocket pin to freely move into and out of a sprocket wheel, and FIG. 5 is a front cross sectional view illustrating a portion thereof.

First, as shown in FIGS. 4 and 5, designated at 1 is a platen, 2 is a central axle or shaft of the platen 1, 3 is a sprocket wheel, 4 are sprocket pins, 5 is a cam member, 6 is a paper guide, 7 is a locking ring, 8 are washers, 9 is a platen spring, 10 is a bearing, 11 is a gear, and 12 is a spring pin. These members constitute the pin platen mechanism and are supported on side frames 13 of a printer, one side frame being shown in FIG. 5.

In addition, designated at 14 is a bottom paper guide, and 15*a* and 15*b* are respective media such as continuous paper tablets or sheets, each media having sprocket holes through both sides thereof into which the sprocket pins 4 are fitted.

Designated at 16 is a pressure roller disposed to push the medium 15*a* or 15*b* against the platen.

Likewise, designated at 17 is a main shaft disposed parallel to the platen 1, and 18 is a carriage mounted on the main shaft 17, on which carriage 18 is mounted a print head 19 having a tip end surface adapted to face the platen 1. Further attached to carriage 18 via a bracket 22 is a ribbon protector 21 for preventing the medium 15*a* from being stained by an inked ribbon 20 set so as to pass through the tip end surface of the print head 19.

Designated at 23 is a slider mounted on the lower surface of the rear portion of the carriage 18, and 24 is a guide frame permitting the slider 23 to be engaged slidably therewith. The carriage 18 is adapted to reciprocate along the platen 1 axially thereof with the aid of a drive source (not shown) while being guided by the guide frame 24 and by the main shaft 17.

Respective parts of the pin platen mechanism will be described in further detail with reference to FIG. 6.

FIG. 6 illustrating a prior pin platen mechanism is an exploded perspective view. Opposite ends of central shaft or axle 2 are formed to provide portions 2*a* having opposite flattened surfaces and circular end portions 2*b* having respective stopper holes 2*c* formed therein.

Each sprocket wheel 3 has through the center thereof a mounting hole 3*a* adapted to fit complementarily on the respective flattened part 2*a* of the central shaft 2, as well as a plurality of holding or retaining holes 3*b* extending radially from the circumferential surface thereof toward the center thereof, and further has a stopper groove 3*c* provided circumferentially at one axial end thereof. In addition, each sprocket pin 4 includes a projection 4*a* formed on the base thereof.

Each ring cam member 5 has a substantially D-shaped annular cam groove 5*a* formed in one axial end thereof and fixing projections 5*b* formed on the opposite axial end thereof.

Each paper guide 6 has fixing holes 6*a* corresponding to the fixing projections 5*b* as well as a guide portion 6*b* extending from the outer periphery thereof at one axial end thereof, the guide portion 6*b* having therein a pin groove 6*c* and a notch portion 6*d*. Moreover, the paper guide 6 has on the opposite axial end thereof a plurality of circular arc-shaped first holder parts 6*e* and second holder parts 6*f* formed to define a cylinder, any one of the second holder parts 6*f* having on the inner surface thereof an anti-rotation projection 6*g*.

Furthermore, the first holder parts 6*e* are thicker and have larger outer diameters than the second holder parts 6*f*.

Each locking ring 7 has on the outer periphery thereof a lever 7*a* and a plurality of stopper pawls 7*b* and further has on the inner periphery thereof a locking projection strip 7*c* corresponding to the first holder parts 6*e* of the paper guide 6 and an unlocking groove 7*d*.

Each of the ends 2*b* of the central shaft 2 is rotatably supported in a respective bearing 10, in the peripheral surface of which is provided an anti-rotation groove 10*c* corresponding to the anti-rotation projection 6*g* of the respective paper guide 6, and in the vicinity of one end of bearing 10 is provided a blade portion 10*a* having anti-falling-off projections 10*b*.

Moreover, the side frames 13 are provided in confronting relation with each other, each of the frames 13 has a support part 13*a* notched into a U-shape and anti-falling-off holes 13*b* corresponding to anti-falling-off projections 10*b* of the respective bearing 10. Designated at 25 is a knockout pin.

In succession, assembly of these parts now will be described.

First, the base parts of the sprocket pins 4 are inserted into the respective holding holes 3*b* in the sprocket wheel 3 while the cam member 5 is fitted in the inside of the sprocket wheel 3 so as to permit the projections 4*a* of sprocket pins 4 to extend into the cam groove 5*a*. In addition, the paper guide 6 is brought into contact with the cam member 5 with the first holder parts 6*e* and the second holder parts 6*f* positioned outwardly of the cam member 5 with respect to the shaft center, and with fixing projections 5*b* fitted in fixing holes 6*a*. Thereafter, the locking ring 7 is fitted to the outer peripheries of the first and second holder parts 6e and 6f of the paper guide 6, and tip portions of the plurality of the stopper pawls 7b formed on the locking ring 7 are engaged in the stopper groove 3c in the sprocket wheel 3 All the members described above are thus integrally united.

The locking ring 7 is adapted to be rotatable with the stopper pawls 7b engaged in the stopper groove 3c, and a first holder part 6e is adapted upon engagement of the above members with each other to enter the unlocking groove 7d in the locking ring 7.

Then, these parts 3 to 7 integrally united as such are inserted onto the left end of the central shaft 2 of the platen 1, the mounting hole 3a in the sprocket wheel 3 is fitted on the flattened part 2a provided on the central shaft 2, and the platen spring 9 is mounted on the end part 2b of the central shaft 2 in a sandwiching relation between the washers 8. Thereafter, the bearing 10 and the gear 11 are respectively fitted to the end part 2b of the central shaft 2, and finally the spring pin 12 is inserted into gear 11 and the stopper hole 2c formed through the central shaft 2 to prevent the respective parts from being removed from the shaft.

On the other hand, for the right side of the central shaft 2, the sprocket wheel 3, cam member 5, paper guide 6, locking ring 7, and bearing 10 are likewise combined and mounted on the central shaft 2, and the knockout pin 25 is inserted into the stopper hole 2c to prevent these parts from being removed from the shaft.

After assembling the pin platen mechanism by mounting the respective parts on the right and left sides of the central shaft 2 as described above, the respective bearings 10 are pushed into the support parts 13a of the left and right side frames 13 and fixed thereon so as not to be rotatable with respect thereto, with the anti-falling-off projections 10a provided on the blades 10b of the bearings 10 respectively fitted in the anti-falling-off holes 13b formed in the side frames 13, whereby the pin platen mechanism is supported by the side frames 13.

The platen spring 9 in this state makes contact at opposite ends with a stepped portion formed in the interior of the bearing 10 and the end surface of the flattened portion 2a provided on the central shaft 2 via the washers 8 to press the central shaft 2 for absorbing any back lash produced in the platen 1 upon assembly thereof.

In addition, the anti-rotation projection 6g provided on the second holder part 6f of each paper guide 6 has thereupon been fitted in the anti-rotation groove 10c in the respective bearing 10 fixed non-rotatably on the side frame 13 as described previously to prevent the paper guide 6 from being rotated. Moreover, each cam member 5 has its fixing projections 5b fitted in the fixing holes 6a in the respective paper guide 6, and thus is also prevented from rotating, while being aligned with a linear part of the cam groove 5a oriented vertically on the side of the ribbon protector 21. Only the sprocket wheels 3 which holds the sprocket pins 4 are adapted to be rotatable together with the central shaft 2 and the platen 1 by permitting the mounting hole 3a formed in the sprocket wheels 3 to be fitted to the flattened portions 2a of the central shaft 2.

Furthermore, the right and left paper guides 6 are respectively mounted on the right and left sides of the central shaft 2 symmetrically thereof, and hence are positioned when assembled as described above so as to permit the respective notched portions 6d to correspond to the bottom paper guides 14 as shown in FIG. 4.

The operation of the above arrangement now will be described.

First, when the first holder parts 6e of the paper guides 6 are fitted into respective of the unlocking grooves 7d in the locking rings 7, the first holder parts 6e make slight contact with the bearings 10 inserted into the inside of the first holder parts or are separated therefrom by small gaps, and hence the sprocket wheels 3, cam member 5, and paper guides 6 integrally united with the locking rings 7 are axially movable. Thus, these members are moved to adjust for the width of the medium 15a or 15b, whereby the left and right paper guides 6 are positioned to align with both side edges of the medium 15a or 15b.

Thereafter, with the lever 7a of each locking ring 7 being rotated manually by a prescribed angle in a prescribed direction, the locking projection strip 7c provided on the inside of the locking ring 7 moves around the outside of the first holder parts 6e of the paper guide 6 to clamp the respective first holder parts 6e inwardly to thereby bring them into contact with the outer peripheral surface of the bearing 10, whereby the paper guide 6, the cam member 5, and the sprocket wheel 3 are fixed.

After this operation, when employing the medium 15a, such medium 15a is inserted between the sprocket wheels 3 and the guide parts 6b of the paper guides 6 from the back side of the platen 1, and the sprocket holes in the medium 15a are fitted to the tips of the sprocket pins 4 projecting externally from the sprocket wheels 3, while the medium 15a is wound around the platen 1 and is forced to pass between the platen 1 and the pressure roller 16 while being guided in a prescribed direction.

In addition, when employing the medium 15b, such medium 15b is inserted into the bottom paper guide 14 from below and is forced to pass through the notched portions 6d in the paper guides 6, and the sprocket holes in the medium 15b are fitted to the tips of the sprocket pins 4, while the medium 15b is wound around the platen 1 and is forced to pass between the platen 1 and the pressure roller 16 while being guided in a prescribed direction.

In this situation, the carriage 18 is moved axially of the platen 1 and the print head 19 is driven for printing on the medium 15a or 15b, and furthermore the medium 15a or 15b is advanced by one line for each axial printing movement.

This feeding of the medium 15a or 15b is effected by rotating the platen 1 and the sprocket wheels 3 integrally with the central shaft 2 through the transmission of rotary power of a line feed motor, etc., (not shown) to the gear 11. Thereupon, although the sprocket pins 4 are disengaged from the sprocket holes in the medium 15a or 15b in the vicinity of the pressure roller 16, other sprocket pins 4 are fitted into other sprocket holes in the vicinity of the pin grooves 6c in the paper guides 6 or in the vicinity of the notched portions 6d for thereby permitting the medium 15a or 15b to be fed in succession.

Moreover, although as the sprocket wheels 3 are rotated, the respective sprocket pins 4 are also rotated, since the cam members 5 are fixed as described previously, the projections 4a of the respective sprocket pins 4 freely fitted in the substantially D-shaped cam grooves 5a provided in the cam members 5 are moved according to the shape of the cam grooves 5a.

Since each cam groove 5a is substantially D-shaped as described above, its linear portion is arranged vertically on the side of the printing surface, when the projection 4a of a given sprocket pin 4 is moved along such linear portion, the tip end of the sprocket pin 4 is forced to withdraw into the holder hole 3b in the sprocket wheel 3 following the corresponding movement of the projection, and the tip end of the sprocket pin 4 is projected from the holder hole 3b toward the outside of the sprocket wheel 3 when the projection 4a passes beyond the linear portion.

Thus, even if the ribbon protector 21 is moved to the end surface of the platen 1 together with the print head 19 by the carriage 18 during the above printing movement or upon finishing of such printing movement, the sprocket pin 4 does not disturb the movement of the ribbon protector 21.

As described above, since the known pin platen mechanism shown in FIGS. 4 to 6 is adapted to cause the tip ends of the sprocket pins to withdraw into the retaining holes in the sprocket wheels on the side of the printing surface, the movement of the ribbon protector is not disturbed, and thereby the carriage, on which the ribbon protector is mounted, is permitted to be moved over a wider extent. However, since the tip ends of the sprocket pins are positively withdrawn into the holder holes on the side of the printing surface without fail, the number of the effective sprocket pins engaging the medium is reduced, thus resulting in a reduction of feeding capability of the mechanism as a whole.

Moreover, with a reduced contact area, as with a medium fed through the bottom paper guide, between the medium and the sprocket wheels, the reduction of the effective number of sprocket pins achieving feeding of the medium as described above is very disadvantageous. Furthermore, upon copying and the like the sprocket pins can become disengaged from the sprocket holes owing to swelling due to fixing needles, pastes, etc., for tying those media up into a bundle, thus resulting in difficulty in feeding of the media.

SUMMARY OF THE INVENTION

In view of the above drawbacks with the conventional pin platen mechanism, it is an object of the present invention to provide a pin platen mechanism wherein the movement of a carriage is not limited, the media feeding capability is improved, and secure feeding of the media is achieved even with a copying operation.

To achieve the above objects, a pin platen mechanism according to the present invention includes a platen for permitting a medium having sprocket holes to be wound therearound and supported thereon, bearings for rotatably supporting both ends of a central shaft of the platen, sprocket wheels respectively mounted on the central shaft of the platen so as to be rotatable integrally with the platen, cam members respectively engaged with the bearing so as to be incapable of rotation with the sprocket wheels, a plurality of sprocket pins, each having a projection provided on a base part thereof and freely fitted in an annular cam groove formed in the respective cam member, tip parts of the projections projecting to the outside of the sprocket wheels, the sprocket pins being inserted into retaining holes provided radially in the sprocket wheel, the sprocket holes formed through the medium being fitted to the sprocket pins such that rotation of the sprocket wheels integrally with platen and the central shaft thereof achieves feeding of the medium, coiled springs mounted in the respective retaining holes formed in the sprocket wheels for biasing the sprocket pins to the outside at all times, the cam groove formed in the cam member including a widened portion, and the tip ends of the respective sprocket pins being permitted to withdraw into the holder holes at the position of the widened part.

According to the pin platen mechanism arranged as described above, rotation of the sprocket wheels effected integrally with the platen and the central shaft does not usually cause the tip ends of the sprocket pins to withdraw into the holder holes. Rather, only when the ribbon protector is moved to the end surface of the platen by the carriage together with the print head and strikes the tip end of a sprocket pin located at the wider part of the respective cam groove and to push the same, will such sprocket be withdrawn into the retaining hole.

Accordingly, the sprocket pin does not prevent the ribbon protector from moving, and hence the movement of the carriage is not limited. However, at the same time the number of sprocket pins effective for feeding the medium is not reduced. Thus, the pin platen mechanism of the present invention improves the medium feeding capability as a whole, and disadvantageous reduced contact area of a medium with the sprocket wheels also is eliminated. Furthermore, the sprocket pins also are prevented from being disengaged from a medium slightly swelled owing to fixing needles and paste, etc., for copying and the like, thereby effecting secure medium feed.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
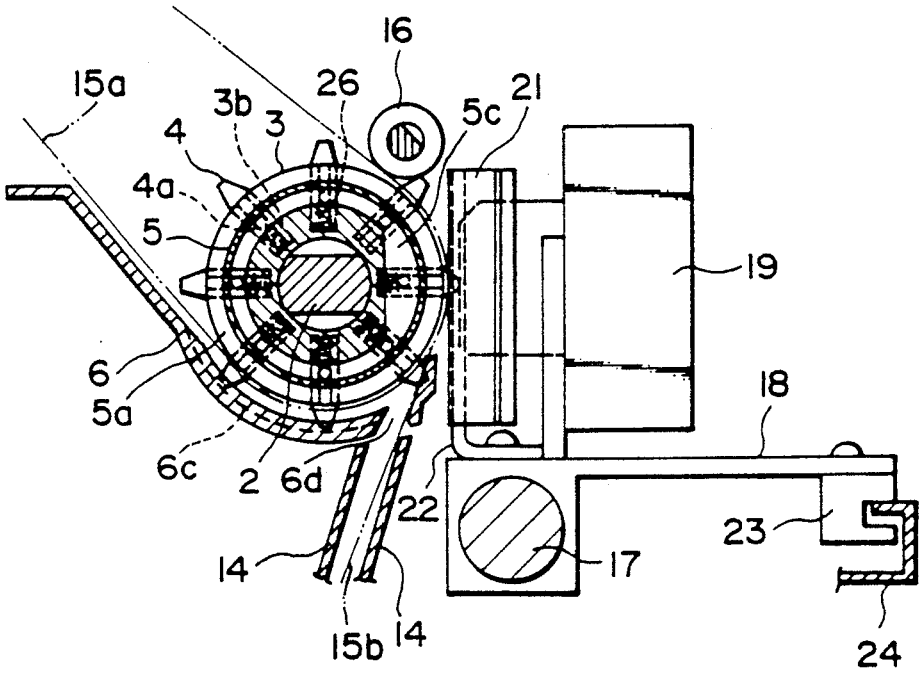
FIG. 1 is a side cross sectional view illustrating an embodiment of a pin platen mechanism according to the present invention.
Figure 2:
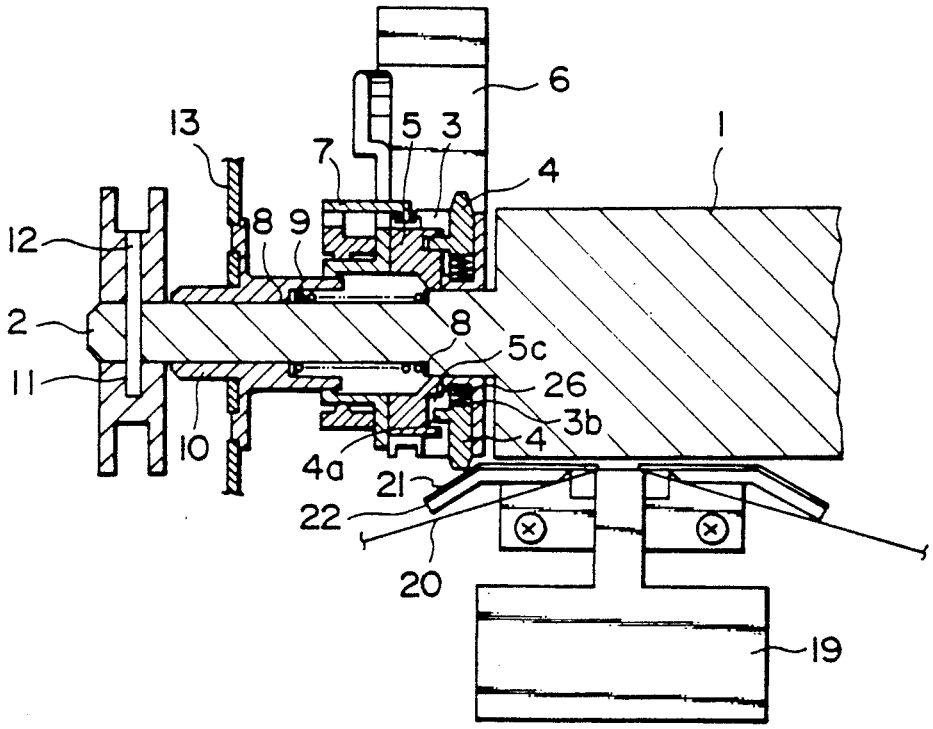
FIG. 2 is a horizontal cross sectional view illustrating a left side portion of the mechanism of FIG. 1.
Figure 3:
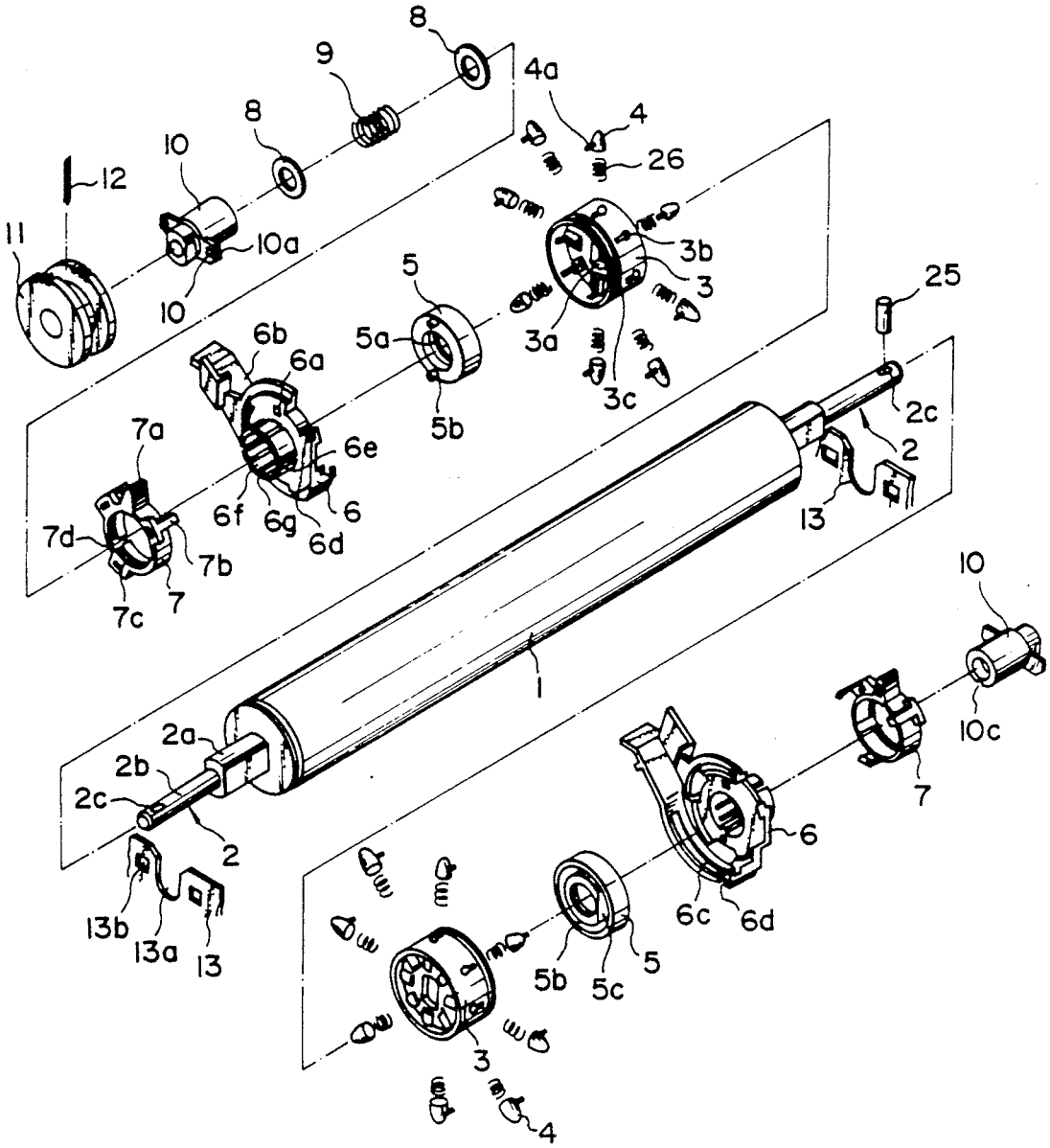
FIG. 3 is an exploded perspective view of the mechanism of FIG. 1.

An embodiment of a pin platen mechanism according to the present invention will be described with reference to FIGS. 1–3 of the accompanying drawings.

Figure 4:
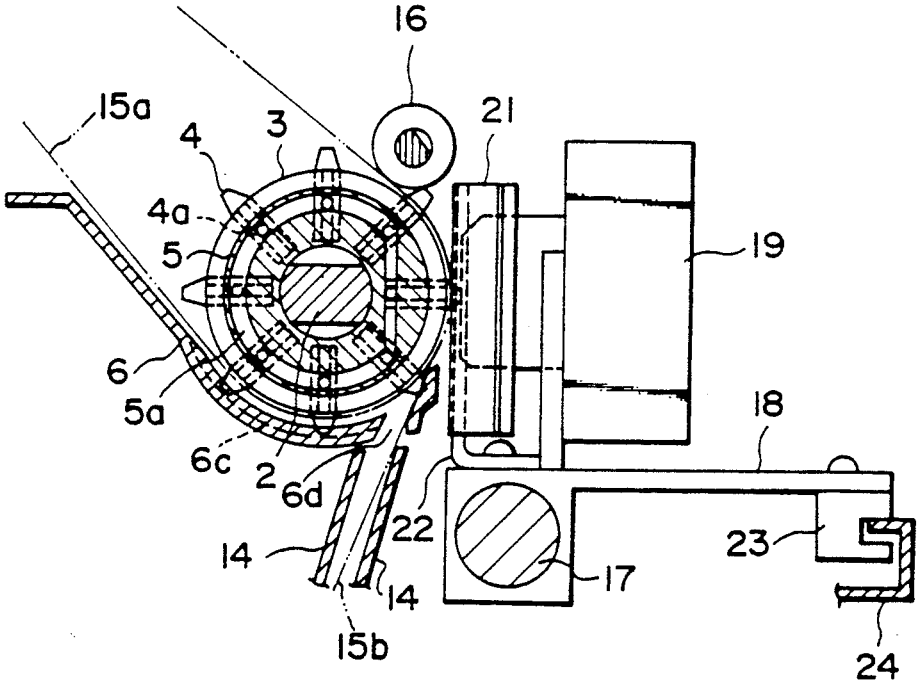
FIG. 4 (PRIOR ART)
FIG. 4 is a side cross sectional view illustrating a known pin platen mechanism.
Figure 5:
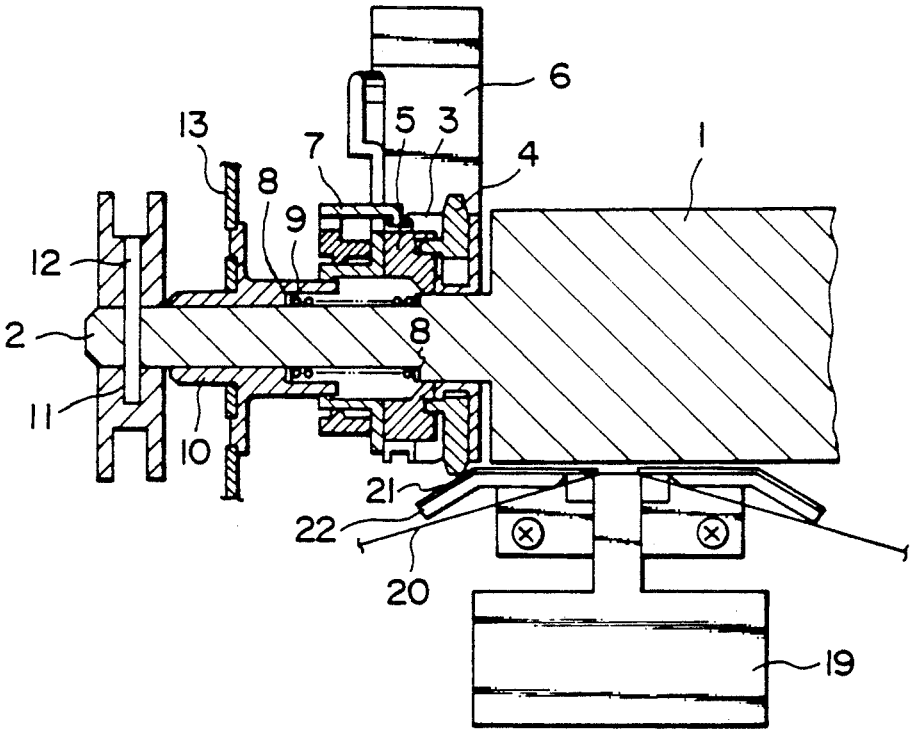
FIG. 5 (PRIOR ART)
FIG. 5 is a horizontal cross sectional view of a lift side portion of the mechanism of FIG. 4.
Figure 6:
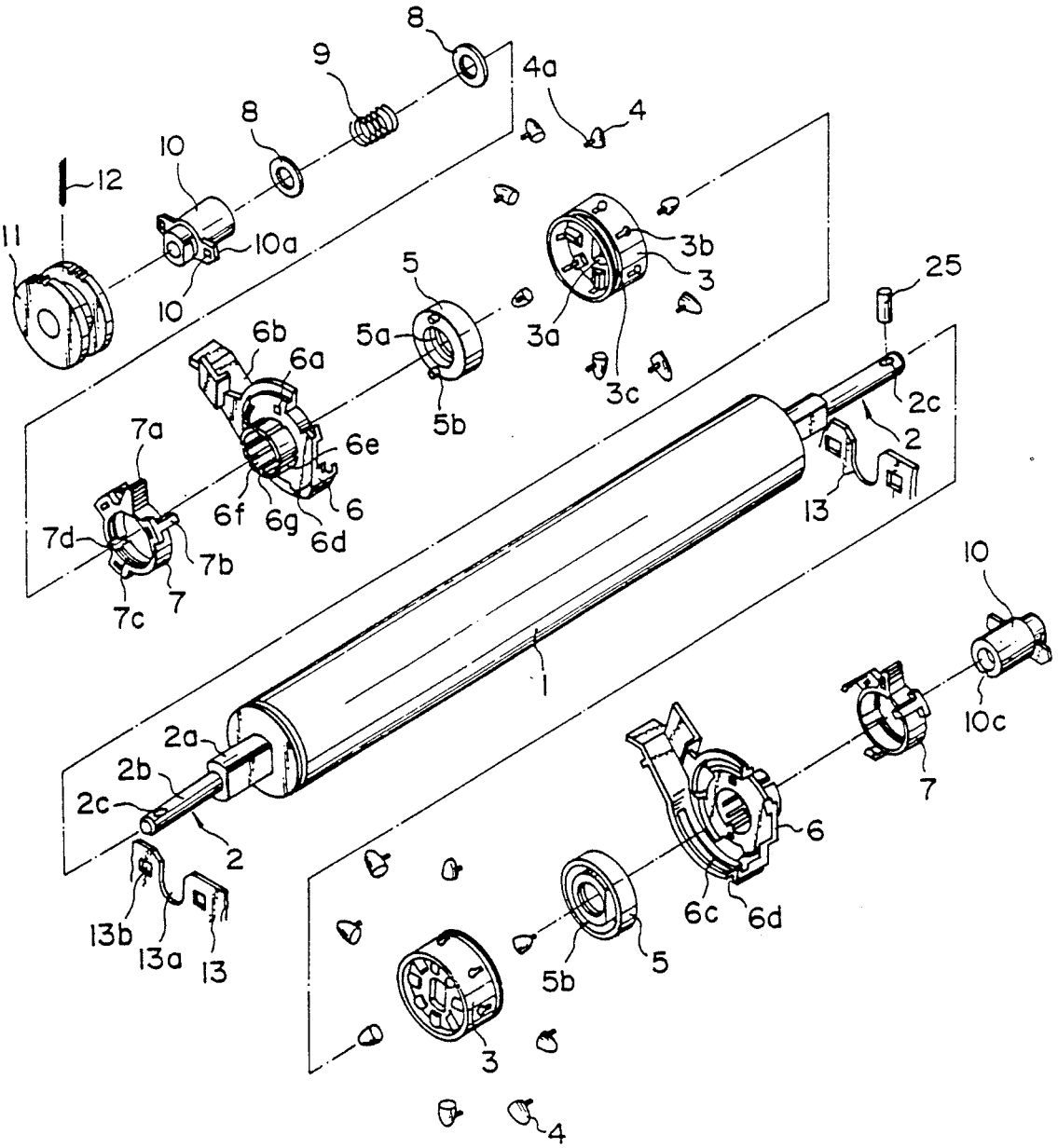
FIG. 6 (PRIOR ART)
FIG. 6 is an exploded perspective view of the pin platen mechanism of FIG. 4.

Referring thereto, the numeral 1 is a platen, 2 is a central shaft, 3 are sprocket wheels, 4 are sprocket pins, 5 are cam members, 6 are paper guides, 7 are locking rings, 8 are washers, 9 is a platen spring, 10 are bearings, 11 is a gear, 12 is a spring pin, 13 are side frames, 14 is a bottom paper guide, and 25 is a knockout pin. Although these respective members correspond to like members of the known mechanism described with reference to FIGS. 4 to 6, in the present embodiment the cam groove 5a formed in each cam member 5 is ring-shaped and includes a wider part 5c substantially segment-shaped as shown in FIGS. 1 and 2. In addition, coiled springs 26 biasing sprocket pins 4 to the outside at all times are respectively mounted in the holder holes 3b formed in the sprocket wheels 3, and the wider parts 5c are oriented vertically on the side of the printing surface.

Moreover, the numeral 14 is a bottom paper guide, 15a and 15b are respective media. 16 is a pressure roller, 17 is a main shaft, 18 is a carriage, 19 is a print head, 20 is an inked ribbon, 21 is a ribbon protector, 22 is a bracket, 23 is a slider, and 24 is a guide frame. These members are also the same as those members of the known arrangement described previously.

The operation of the above arrangement of the pin platen mechanism according to the present invention now will be described.

First, width adjustment of the paper guides 6 for the medium 15a or 15b and setting of the medium 15a or 15b is effected in the same manner as in the prior case described above, as is the printing operation. Thus, feeding of the medium 15a or 15b will be described herein.

The medium 15a or 15b, when set in the pin platen mechanism, has its sprocket holes fitted on the sprocket pins 4 of the sprocket wheels 3. Accordingly, the medium 15a or 15b is pulled by the sprocket pins 4 and fed by rotating the platen 1 and the sprocket wheels 3 integrally with the central shaft 2 through the transmission of turning force of a line feed motor, etc., (not shown) to the gear 11.

In addition, a sprocket pin 4 of each sprocket wheel 3 is disengaged during the rotation of the sprocket wheel 3 from the sprocket holes in the medium 15a or 15b in the vicinity of the pressure roller 16, but another sprocket pin 4 is newly fitted into another sprocket hole in the vicinity of the pin groove 6c in the paper guide 6 or in the vicinity of the notched portion 6d to continue feeding of the medium 15a or 15b.

In the present embodiment, the cam groove 5a in each cam member 5 is provided with the wider part 5c as described previously, and the respective sprocket pins 4 are biased at all times to the outside by the coiled springs 26. Therefore, with each sprocket wheel 3 being rotated, the projections 4a of the sprocket pins 4 freely fitted in the cam groove 5a are respectively moved in the wider portion 5c of the cam groove 5a along the outer periphery of the wider portion 5c, whereby each sprocket pin 4 is usually prevented from withdrawing into the retaining hole 3c, although the sprocket wheel 3 is rotated, and stay fitted in the respective medium sprocket hole.

When the ribbon protector 21 is moved to the end surface of the platen 1 together with the print head 19 by the carriage 18 during printing or upon the completion of printing, the ribbon protector 21 strikes the tip end of the sprocket pin 4 on the side of the printing surface and pushes it. However, the projection 4a of such sprocket pin 4 at such time is in the wider portion 5c of the cam groove 4a and is capable of moving back widthwise. Thus, the tip part of the sprocket pin 4, when pushed by the ribbon protector 21, withdraws into the retaining hole 3c formed in the sprocket wheel 3 and hence does not disturb the movement of the ribbon protector 21.

In addition, when the ribbon protector 21 is allowed to pass beyond such sprocket pin 4 or is moved in the opposite direction and thus is separated from the sprocket pin 4, the tip end of the sprocket pin 4 is again projected outwardly by the reset force of the coiled spring 26 from the interior of the retaining hole 3c to the outside of the sprocket wheel 3.

In the embodiment described above with the wider part 5c provided in the cam groove 5a, the sprocket pin 4 is adapted to withdraw on the side of the printing surface when pushed by the ribbon protector 21. However, this invention makes it possible to increase the feeding force for feeding the medium 15a or 15b in a portion or area where it is not required for the sprocket pin 4 to withdraw by forcing the sprocket pin 4 to the outside of the sprocket wheel 3 with the aid of the cam groove 5a. Accordingly, the cam groove 5a can be shaped arbitrarily in conformity with the purposes of the use thereof. For example, provided the sprocket pin 4 is shaped to force the sprocket pin 4 to withdraw for passage of a wider medium such as a single tablet, it is also possible to permit the wider medium to pass through the sprocket pin 4 in a best manner.

Furthermore, although the above described embodiment includes structure for altering the later spacing between the paper guides 6, the present invention is not limited thereto and is applicable to all pin platen mechanisms which permit the sprocket pins 4 to go thereinto and out thereof.

According to the present invention, as described above, coiled springs for biasing sprocket pins externally at all times are mounted in the respective retaining holes formed in the sprocket wheels, while a wider portion is provided in part of the cam groove in each cam member in which each sprocket pin is freely fitted. When the ribbon protector is moved to the sprocket wheel together with the print head with the aid of the carriage, the tip part of the sprocket pin, which has reached the wider part of the cam groove, is pushed by the ribbon protector and thereby allowed to withdraw into the retaining hole. Accordingly, the sprocket pin does not disturb the movement of the ribbon protector and hence the carriage is not limited in its extent of movement. Thus, the carriage can be moved over a wider path.

In addition, the tip part of the sprocket pin on a line along which the ribbon protector is moved does not withdraw normally into the retaining hole. Accordingly, there is not a reduction of the number of effective sprocket pins operating for feeding of the medium. Thus, the feeding capability as a whole is improved and it is possible to avoid any inconvenience due to the medium having reduced driving contact with the sprocket wheels. Furthermore, since no disengagement of the sprocket pin from the medium is produced even when the medium is slightly swelled due to fixing needles and paste, etc., for copying and the like, the medium can securely be fed.

Although a certain preferred embodiment has been shown and described, it should be understood that many changes and modifications may be made thereto without departing from the scope of the invention.

What is claimed is:

1. A pin platen mechanism comprising:

a platen for permitting a medium having therein sprocket holes to be wound therearound and for supporting the same;

non-rotatably mounted bearings rotatably supporting opposite ends of a central shaft of said platen;

sprocket wheels mounted on opposite ends of said central shaft of said platen and integrally rotatable therewith;

cam members mounted adjacent respective said bearings and engaged therewith so as not to be rotatable with said platen, each said cam member having formed therein an annular cam groove, and each said cam groove having an inwardly widened portion;

a plurality of sprocket pins inserted in respective retaining holes extending radially inwardly from the periphery of each said sprocket wheel, each said sprocket pin having an inner base portion having a projection extending into said cam groove of the respective said cam member, whereby upon rotation of said platen and said sprocket wheels relative to said cam members said projections of said sprocket pins follow said cam grooves of respective said cam members, and each said sprocket pin having an outer tip end projecting from said periphery of the respective said sprocket wheel, whereby said sprocket pins of said sprocket wheels are adapted to fit into sprocket holes of the medium and, upon rotation of said platen and said sprocket wheels, feed the medium;

spring means mounted in each said retaining hole for continually biasing the respective said sprocket pin outwardly; and each said sprocket pin being movable inwardly against the biasing force of the respective said spring means when said projection of said each sprocket pin is located within said widened portion of the respective said cam groove.

2. A mechanism as claimed in claim 1, wherein said widened portion of each said cam groove is segment-shaped.

3. A mechanism as claimed in claim 1, wherein each said spring means comprises a coil spring.

4. A mechanism as claimed in claim 1, wherein said widened portion of each said cam groove extends substantially vertically.

* * * * *